United States Patent [19]

Kumai et al.

[11] Patent Number: 4,647,305

[45] Date of Patent: Mar. 3, 1987

[54] PROCESS FOR MANUFACTURING AMORPHOUS ALLOY POWDERS

[75] Inventors: Ko Kumai, Kamakura; Tatsuhiko Noda, Yokohama; Tadashi Ichiyama, Sagamihara; Takashi Satoh, Tokyo, all of Japan

[73] Assignee: Nippon Kinzoku Co., Ltd., Japan

[21] Appl. No.: 630,257

[22] Filed: Jul. 12, 1984

[30] Foreign Application Priority Data

Jul. 19, 1983 [JP] Japan ..... 58-131381
Jul. 19, 1983 [JP] Japan ..... 58-131382

[51] Int. Cl.[4] ..... B22F 9/00

[52] U.S. Cl. ..... 75/0.5 B; 75/0.5 BA; 75/0.5 C; 264/12

[58] Field of Search ..... 264/10, 12, 14; 425/6, 425/7; 75/0.5 BA, 0.5 B, 0.5 C, 251, 0.5 R; 148/403; 420/89

[56] References Cited

U.S. PATENT DOCUMENTS

| | | | |
|---|---|---|---|
| 2,402,441 | 6/1946 | Paddle | 425/7 |
| 3,533,136 | 10/1970 | Holtz, Jr. | 425/7 |
| 3,951,577 | 4/1976 | Okayama et al. | 425/7 |
| 4,069,045 | 1/1978 | Lundgren | 75/251 |
| 4,080,126 | 3/1978 | Clark et al. | 425/7 |
| 4,274,864 | 6/1981 | Bernhardt | 75/0.5 R |
| 4,298,553 | 11/1981 | Ayers | 264/11 |
| 4,353,737 | 10/1982 | Ray | 75/0.5 R |

FOREIGN PATENT DOCUMENTS

| | | | |
|---|---|---|---|
| 3014121A1 | 12/1980 | Fed. Rep. of Germany . | |
| 52-49784 | 12/1977 | Japan . | |
| 17693 | 7/1979 | Japan | 420/590 |
| 54-114467 | 9/1979 | Japan . | |
| 55-128507 | 10/1980 | Japan . | |
| 58-84908 | 5/1983 | Japan . | |
| 933264 | 6/1982 | U.S.S.R. | 75/0.5 C |
| 1002096 | 3/1983 | U.S.S.R. | 425/7 |
| 1014663 | 4/1983 | U.S.S.R. | 425/7 |

*Primary Examiner*—Christopher W. Brody
*Attorney, Agent, or Firm*—Bacon & Thomas

[57] ABSTRACT

A process for manufacturing amorphous alloy powders is provided, wherein, a high-speed fluid jet is blown against a flowing melt of an alloy which can be formed into amorphous powders, thereby powerizing the melt and rapidly cooling and solidifying the melt. Use is made of an action tube in which pressure is reduced and turbulent flow is caused so as to increase the cooling rate of the powderized alloy and to form particles of irregular shape. Further, the powderized alloy particles are forced to forcibly collide against a block to increase the cooling rate of the alloy and to form particles of irregular shape.

22 Claims, 13 Drawing Figures

X200

X200

PROCESS FOR MANUFACTURING AMORPHOUS ALLOY POWDERS

BACKGROUND OF THE INVENTION

The present invention relates to a process for manufacturing amorphous alloy powders, comprising the steps of: causing the molten metal which may be rendered amorphous to flow down from a nozzle of a crucible; and blowing a high-speed fluid from a spraying nozzle arranged below the nozzle of the crucible against the melt, thereby powderizing the melt.

Various processes for manufacturing an amorphous alloy in accordance with the shape (e.g., leaf-like shape, thin strip-like shape, thin wire-like shape, or powder) of an amorphous alloy to be manufactured are conventionally known.

The processes for manufacturing leaves of an amorphous alloy include the gun method, the piston-anvil method, the torsion-catapult method, and the like. The processes for continuous manufacturing a thin strip of an amorphous alloy include the centrifugal method, the melt-spinning method, and the double-roll method. The process for manufacturing thin wires include the water flow spinning method and the rotating fluid spinning method. The processes for manufacturing amorphous powders include the spray method, the cavitation method, the rotating spray method in fluid, and the atomizing method.

Amorphous alloys have different shapes in accordance with their intended application. Flakes, thin strips or wires of an amorphous alloy have predetermined shapes and are suitable for preparing predetermined parts, but are not suitable for parts having an arbitrary shape. In contrast to this, amorphous alloy powder yields, upon being pressed, elements, parts and the like of arbitrary complex shapes.

According to the principle of the atomizing method of manufacturing amorphous alloy powders, when molten metal is injected through a nozzle, a high-speed fluid jet (high-pressure gas, high-pressure steam, or high-speed water jet) is supplied to atomize the molten metal and to rapidly cool and solidify it. However, although the cooling rate of the conventional atomizing method is sufficient to allow preparation of fine amorphous powders, it is not sufficient to allow preparation of relatively coarse amorphous powders with satisfactory yield. For this reason, when amorphous alloy powders are prepared by the conventional atomizing method, a relatively large portion of the molten alloy is not formed into amorphous powders, resulting in a low manufacturing efficiency. Furthermore, on a single particle level, some particles are only partially rendered amorphous (only at the surface), resulting in a nonuniform degree of amorphousness. When such partially amorphous particles are used, the characteristics inherent in the amorphous alloy powder are deteriorated and a part having the desired characteristics cannot be prepared therefrom. Amorphous alloy powders obtained by the conventional method are of the spherical or teardrop particle shape. If such amorphous alloy powders are pressed without using a binder, the particles are unable to be pressed into a compact. Because of this simple particle shape almost no mechanical interaction among particles can be expected. Therefore, a binder is required to prepare an element or a part from amorphous alloy powders with spherical or teardrop particle shape. This imposes the problems of a high manufacturing cost, poor characteristics of a manufactured material or part, and complexity in the manufacturing process if the powder obtained by the conventional method is to be used for the manufacture of parts or the like on an industrial scale.

SUMMARY OF THE INVENTION

It is an aim of the present invention to provide a process for manufacturing amorphous alloy powders, such that even big particles of the alloy powder can be rendered amorphous, so that each particle can be rendered amorphous not only at its surfacial part but also at the interior thereof, and so that each particle is of such a suitable shape that the alloy powders can be pressed into a compact without requiring the use of any kind of binder.

In order to achieve the above aim of the present invention, molten alloy capable of being amorphouslized and high-speed fluid are introduced into an action tube under the spraying nozzle extending along the downwords stream of the melt of the alloy and around the atomizing zone, so that the powderized alloy particles collide against the high-speed fluid due to the pressure reduction and turbulence in the tube. A rapid heat exchange is thereby achieved between the powderized alloy and the high-speed fluid, whereby the powderized alloy is rapidly cooled and solidified, thus forming amorphous powders.

According to another process of the present invention, a powderized alloy is made to collide against a block arranged immediately underneath the spraying nozzle and by a given distance. Due to this collision and a rapid heat exchange between the powderized alloy and the high-speed fluid, the powderized alloy is rapidly cooled and solified, thus forming amorphous powder.

In general, when liquid alloy particles are rapidly cooled with a high-speed fluid jet, a film (e.g., a steam film when rapid-cooling is performed with a high-speed water jet) is formed around each particle. This film prevents heat-exchange between the high-speed fluid jet and the particle. This is considered to be the main factor in lowering the cooling rate and it is not enough for giving to the alloy particles complete amorphous state (i.e., every portion of every particle).

According to the present invention, the pressure reduction caused by the action tube is utilized to force down the powder, thus breaking down the steam films or the like surrounding the particles or to prevent formation of such films, so that the cooling rate is great enough to completely render the powder amorphous state. Furthermore, due to the violent interaction of the steam and powder, the shape of the powder particles can be kept in irregular. Then, the manufacture of parts and the like using such a powder does not require any kind of binders.

According to another process of the present invention, the powder collides against a block so as to break down the steam films or the like surrounding the powders particles, and to increase the cooling rate to allow the alloy particles to become completely amorphous. Furthermore, since the powder more strongly interacts with the steam, the shape of the powder particles turns to irregular and consequently the resultant powder is able to be further processed for the manufacture of parts or the like without requiring the use of a binder.

Thus, in accordance with the present invention, the alloy powder particles can be rendered completely amorphous in state and irregular in shape. Therefore, the amorphous alloy powder manufactured by the process of the present invention allows pressing, forming through rolls, or extrusion without use of a binder. For this reason, amorphous alloy powders can be used in new applications which have heretofore been impossible, such as in manufacturing of a magnetic material or a highly corrosion-resistant material into parts with complex shape.

DETAILED DESCRIPTION OF THE PREFERRED EMBODIMENTS

Figure 1:
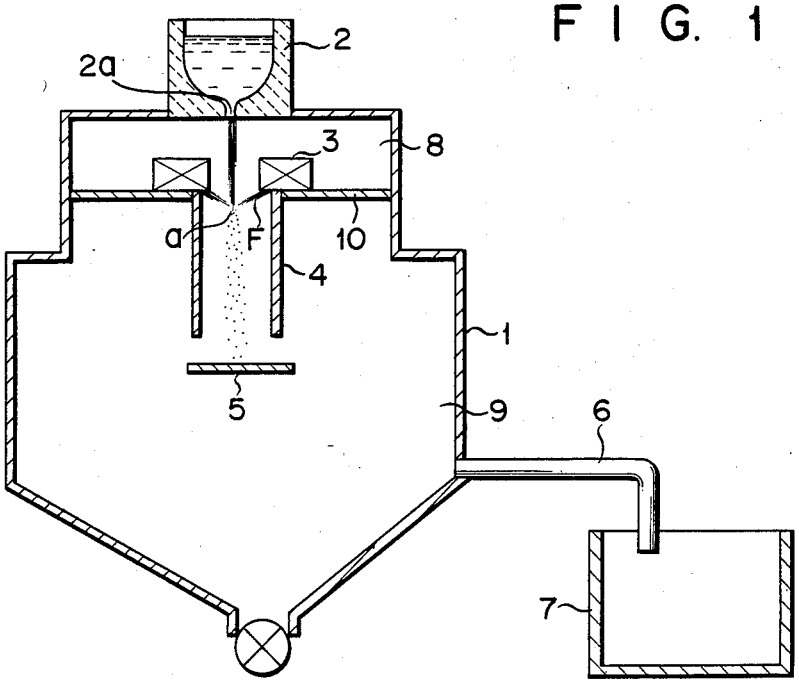
FIG. 1 is a schematic view of an apparatus for manufacturing of amorphous alloy powders for explaining an embodiment of a process according to the present invention.

A description will first be made with reference to an embodiment of a process according to the present invention wherein an action tube reduces pressure and causes turbulent flow to force down powder passing. As illustrated schematically in FIG. 1, an apparatus used in this process has a crucible 2 placed on a tank 1 for manufacturing amorphous alloy powders. The crucible 2 serves to hold therein a melt of an alloy which can be rendered amorphous, the crucible 2 having a nozzle opening 2*a* at the center of its bottom. The nozzle opening 2*a* can be closed or opened by a nozzle stopper (not shown). The melt of an alloy to be turned into amorphous alloy powders held in the crucible 2 may be, for example, a eutectic alloy or a quasi-eutectic alloy having a composition of about 65 atomic % to 85 atomic % of a transition metal element and about 15 atomic % to 35 atomic % of one or more than one metalloid elements. The transition metal element may be one or more metal elements selected from iron, nickel, chromium, cobalt and vanadium. The metalloid element may be one or more metalloid elements selected from boron, carbon, silicon, phosphorus, and germanium. The alloy to be formed into amorphous alloy powders according to the process of the present invention may also be an intermetallic compound alloy or a quasi-intermetallic compound alloy—a combination of two or more transition metals—, an intermetallic compound alloy or a quasi-intermetallic compound alloy—a combination of a transition metal with a metal other than the transition metals—, and an intermetallic compound alloy or a quasi-intermetallic compound alloy—a combination of one or more metals with one or more rare earth metal elements.

A spraying nozzle 3 is arranged of inside of the tank 1 to be located immediately below the nozzle opening 2*a* of the crucible 2 at a distance therefrom. The spraying nozzle 3 is of a conical type and an for spraying a high-speed fluid jet F (e.g., a liquid such as water, or a gas). Since the spraying nozzle 3 is of a conical type, the high-speed fluid jet sprayed from the spraying nozzle 3 is converged (merged) at a convergence point a (FIG. 1) near the opening end at which the high-speed fluid jet merges into a point a. The optimum value of the vertical angle of the conical jet depends on the diameter of the opening at the lower end of the spraying nozzle 3, the speed of the high-speed fluid jet, and the diameter and length of a tube 4 (to be described later). However, in general, the preferable angle falls within a range between 30° to 100°. The preferable speed expressed in terms of pressure P of the high-speed fluid jet is 80 $kgf/cm^2$ or higher for a high-speed liquid and 6 $kgf/cm^2$ or higher for a high-speed gas. Note that the speed is represented by the pressure P since the higher is the pressure P the higher the speed of the fluid jet.

The action tube 4 for reducing pressure and causing turbulence is arranged under the spraying nozzle 3 inside the tank 1 so as to surround an atomizing zone and vertically along the forced direction of the melt. The interior of the tank 1 is divided into the upper and the lower chambers 8 and 9 by a partition wall 10. The upper and lower chambers 8 and 9 communicate with each other through the action tube 4. When the diameter of the action tube 4 is increased, the pressure reducing force increases and consequently the cooling rate of the alloy powder can be increased. However, if the diameter of the action tube 4 is decreased below a certain limit, the powders come to stick to the inner surface of the action tube 4 and further manufacturing of the powder becomes difficult. Considering these factors, the diameter of the action tube 4 preferably is from 0.2 to 3.0 times as much as the diameter of the spraying nozzle 3 at its lower opening. Furthermore, since a longer action tube 4 provides a better effect resulting from the pressure reduction, the action tube 4 preferably has a length of 10 cm or more. The action tube 4 preferably has a cylindrical shape. The force resulting from the pressure reduction is over 20 $mmH_2O$ expressed in terms of the pressure difference between the upper and the lower chambers 8 and 9 (the upper chamber 8 is kept at a lower pressure than the lower chamber 9). Preferably, it is to be of 40 $mmH_2O$ to 200 $mmH_2O$.

As illustrated in FIG. 1, [A] a powder buffer plate 5 is arranged immediately below and at a distance from the action tube 4 within the tank 1. The powder buffer 5 can be mounted on the tank 1 or on the action tube 4 (not specifically shown). However, the powder buffer 5 must be mounted at a level higher than an overflow pipe 6 put at the lower side of the tank 1. An exhaust tank 7 is arranged below the outlet of the overflow pipe 6.

Amorphous alloy powders are manufactured from a melt in the above described way with the arrangement of the action tube 4 and the powder buffer 5, the shape and size of various parts and operating conditions and in the way to be described below.

A melt of an alloy capable to attain amorphous shape is made to flow downward through the nozzle opening 2*a* of the crucible 2, while a high-speed fluid jet is sprayed onto the melt. The melt sprayed with the high-speed fluid is atomized, and is also rapidly cooled and solidified. This powder forming and quenching process take place within the action tube 4, in which the pressure is reduced, and a turbulent flow takes place. Therefore, even if films (e.g., steam films) are formed around the powder particles, this force is able to break these films or to prevent them from forming. As a result of this, the cooling rate of the powder is significantly increased. Thus, all alloy particles, even those of a large size, can be rendered completely amorphous (i.e., right to the center thereof).

The pressure reduction and turbulent flow within the action tube 4 causes water to strongly acts on the alloy powder to render the powder particles the irregular shape. Thus, on pressing of the resultant amorphous alloy particles they come to mechanically interlock to each other to allow for the easy manufacturing of elements, parts and the like.

Alloy powders goes amorphous and irregular in shape collides against the powder buffer 5, drop to the bottom of the tank 1, and are then collected in the exhaust tank 7 through the overflow pipe 6. Thereafter, the amorphous alloy powders are taken out the tank 1 or 7, and water or the like attached to the powder particles is removed. In the process described above, after the alloy powders have collided against the powder buffer 5, they are accumulated at the bottom of the tank 1. Therefore, fluctuation in the water level within the tank 1 is suppressed. Using water as the high-speed fluid, the water is collected at the bottom of the tank 1 upon colliding the alloy powders against the water surface, the water level comes to frequently change. Thus, variations in the pressure difference between the upper and the lower chambers 8 and 9 due to water level fluctuations are prevented, and the powder can be manufactured in a stable manner.

Another embodiment of a process for manufacturing an amorphous alloy powder will now be described with reference to the apparatus schematically illustrated in FIG. 2.

Figure 2:
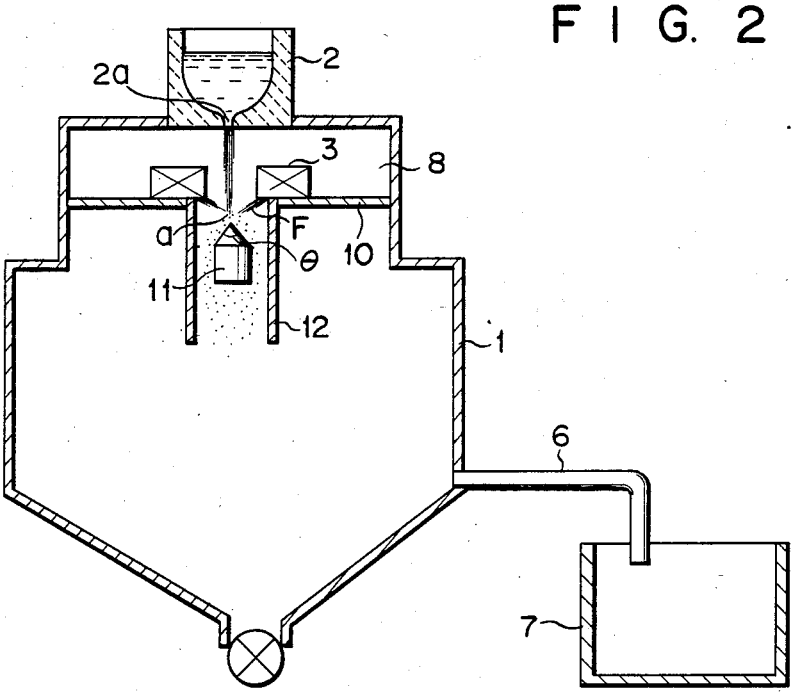
FIG. 2 is a schematic view of another apparatus for manufacturing of amorphous alloy powders for explaining another embodiment of a process according to the present invention.

The apparatus shown in FIG. 2 is different from that shown in FIG. 1 in that the spraying nozzle and tube used in FIG. 1 are omitted, and a block 11 for rapidly cooling the powder and a wall member 12 for preventing scattering of the powder are arranged in the inside of a tank 1 instead. The arrangement and structure of the remaining parts of the apparatus shown in FIG. 2 are the same as those shown in FIG. 1, and therefore the same reference numerals in FIG. 2 denote the same parts in FIG. 1 and a detailed description thereof will be omitted. A description will therefore be made with reference to the block 11 and the wall member 12. The block 11 is arranged immediately below and at a distance from a spraying nozzle 3. The block 11 is preferably arranged immediately below a convergence point a (as defined in the description of the first embodiment). The block 11 has a top portion of a conical shape so as to receive the alloy powders at its inclined surface. A vertical angle $\theta$ of the cone at the top of the block 11 preferably falls within a range of 30° to 150° so as to allow the smooth downward flow of the alloy powder. The material of the block 11 must have good heat resistance, corrosion resistance, and thermal conductivity. Examples for such a preferable material include chromium-plated steel or chromium-plated steel having a water-cooling structure in inside.

The wall member 12 has a hollow shape and preferably a cylindrical shape. The wall member 12 is arranged around the block 11 at a distance therefrom and serves to prevent scattering of the alloy powder upon collision against the block 11. If the diameter of the wall member 12 is too small, the powder becomes to stick to the inner surface of the wall member 12 and further manufacturing of the alloy powder becomes difficult or impossible. In view of this, the wall member 12 preferably has a diameter 10 to 100 mm larger than that of the block 11.

For the apparatus shown in FIG. 1 other factors such as the tapered angle of the spraying nozzle 3, the spraying pressure of the high-speed fluid jet, and the composition of the alloy melt are similar to those of the apparatus shown in FIG. 2. It is possible to wake the inner space of the wall members 12 to work in the similar way that the action tube does in FIG. 1.

Manufacturing of amorphous alloy powders are in the apparatus shown in FIG. 2 goes on in the manner described below. A melt of an alloy which can be rendered amorphous is made to flow downward through a nozzle opening 2*a* of a crucible 2 while a high-speed fluid jet is sprayed against the melt. Thus, the melt sprayed with the high-speed fluid jet is powderized and the powder particles collide against the block 11 to be rapidly cooled and solidified. Although films (steam films or the like) are formed around the powder particles during this step of rapid cooling/solidification, they are simultaneously broken and rapidly cooled by the block 11 when the particles collide against the block 11. As a result, the cooling rate of the powder is significantly increased, so that any powder particles, including those of large size can be turned to amorphous stable and surely, right into the center of every particle.

Furthermore, when the powder collides against the block 11, the powder particles are rendered irregularily in shape. When the resultant amorphous alloy powders are pressed, the particles interlocking to each other wake possible to easily set elements, parts and the like of any desired shape.

Giving to the wall member 12 the pressure reducing function the effects for obtaining the powder in the amorphous state and irregular shape is significantly intensified.

The present invention will now be explained in referring to its examples.

Examples 1 to 6 were performed using the apparatus shown in FIG. 1, and Examples 7 to 12 were performed using the apparatus shown in FIG. 2. In each of Examples 1 to 12, water was used as a high-speed fluid jet.

EXAMPLE 1

Five kilograms of an alloy having a composition of 80 atomic % Fe, 13 atomic % P and 7 atomic % C were melted, and the resultant melt was made to flow through the nozzle opening of the crucible at a melt temperature of 1,400° C. Water was sprayed from the spraying nozzle against the flowing melt (opening angle of 65°) at a atomizing pressure of 125 kg and a flow rate of 290 l/min. A force was applied at the inside of the action tube so as to allow the powder to collide against the powder buffer, thereby providing an amorphous alloy powders of Example 1 (No. 1). In this case, the action tube had inner diameter of 50 mm and length of 400 mm. Pressure difference was 110 mm$H_2O$ between the upper and the lower chambers.

The size distribution of the resultant amorphous alloy powders obtained in this manner was examined, and the results are shown in Table 1 below. For the purpose of comparison, the other amorphous alloy powders (Conventional method; No. 2) manufactured with the apparatus shown in FIG. 1 with the action tube and powder buffer removed therefrom. The size distribution of the resultant powder was examined, and the results are also shown in Table 1 below.

TABLE 1

| | | Size distribution | | | | | | | | |
|---|---|---|---|---|---|---|---|---|---|---|
| Mesh | | +100 | +120 | +145 | +170 | +200 | +250 | +280 | +350 | −350 |
| Particle size (μm) | | 149 | 125 | 105 | 88 | 74 | 63 | 53 | 44 | 44 |
| This invention | No. 1 | 12.07 | 4.37 | 3.95 | 3.16 | 4.60 | 5.16 | 4.35 | 5.24 | 57.09 |
| Conventional method | No. 2 | 1.53 | 2.03 | 4.05 | 2.98 | 6.68 | 6.51 | 5.43 | 7.21 | 63.58 |

Figure 3A:
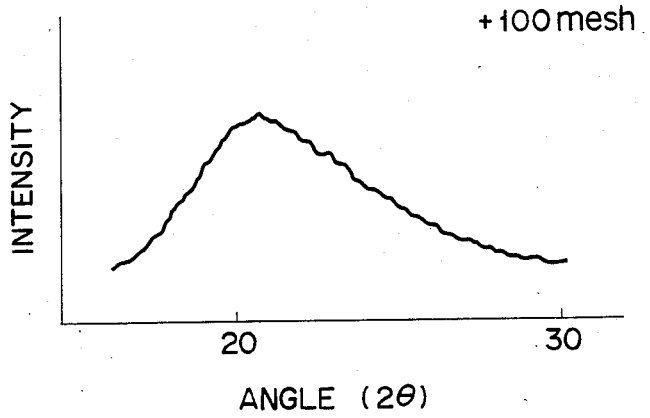
FIGS. 3(*a*) to 3(*c*) show the results obtained in an X-ray diffractiometry demonstrating that alloy powders of +100 mesh, −100 to +350 mesh, and −350 mesh manufactured in the process of the present invention (with the apparatus shown in FIG. 1) are completely in amorphous state.
Figure 3B:
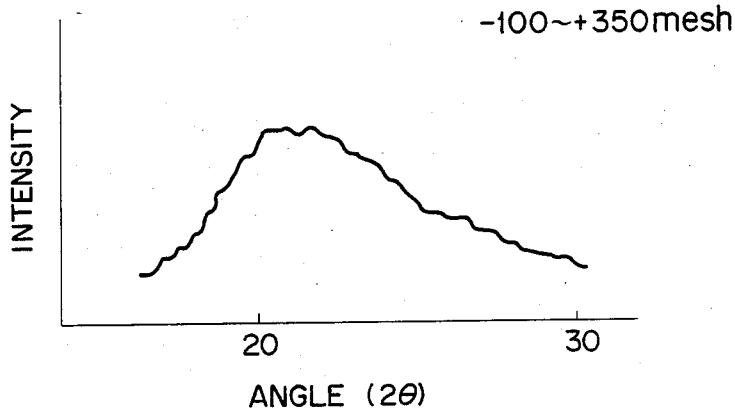
Figure 3C:
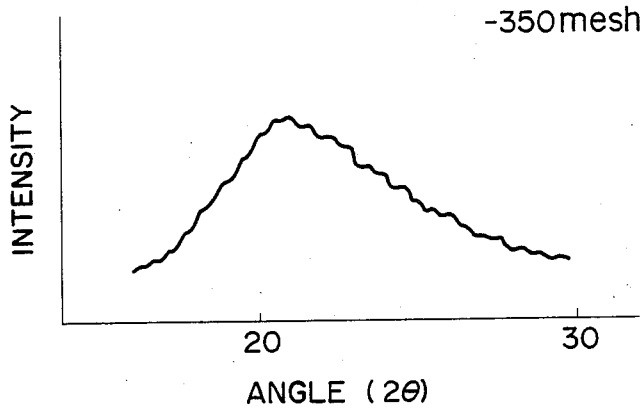
Figure 4A:
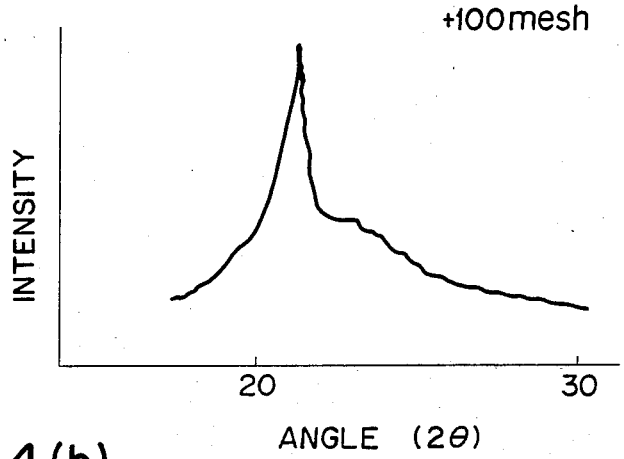
FIGS. 4(*a*) to 4(*c*) are graphs showing the results obtained in an X-ray diffractiometry performed so as to examine the degree of amorphousness of alloy powders of +100 mesh, −100 to +350 mesh, and −350 mesh obtained by the conventional process (a tube and a powder buffer are removed from the apparatus shown in FIG. 1) and alloy powders are manufactured.
Figure 4B:
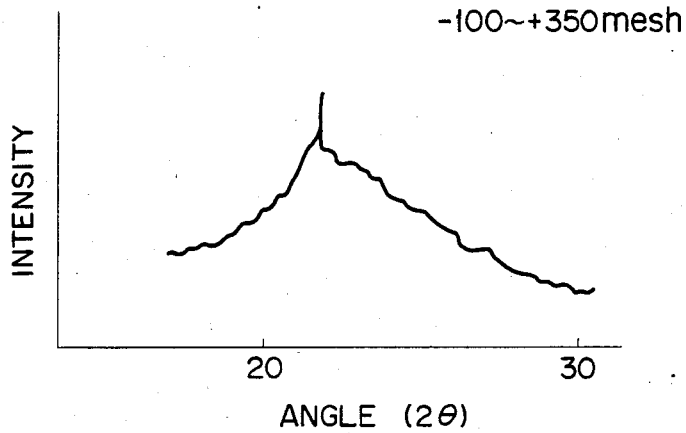
Figure 4C:
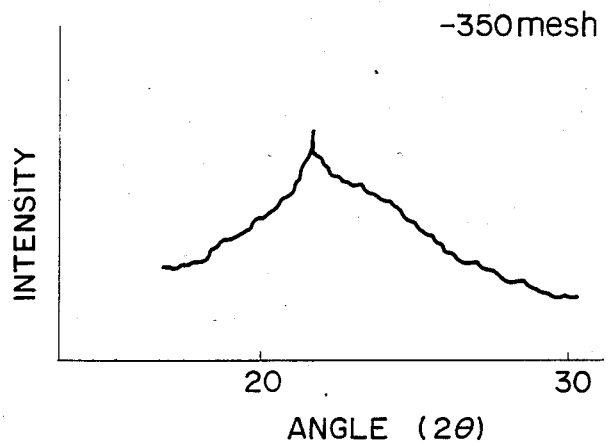

From the powders (No. 1) of Example 1 such part of particles having a particle size of +100 mesh, −100 to +350 mesh or −350 mesh were subjected to X-ray diffractiometry to examine the degree of amorphousness. The results are shown in FIGS. 3(*a*) (+100 mesh), 3(*b*) (−100 to +350 mesh), and 3(*c*) (−350 mesh). The powder (No. 2) manufactured by the conventional process was also subjected to X-ray diffractiometry to examine the degree of amorphousness. The results are shown in FIGS. 4(*a*) (+100 mesh), 4(*b*) (−100 to +350 mesh), and 4(*c*) (−350 mesh). It can be seen from FIG. 3 that the powder of Example 1 does not have a crystalline diffraction pattern (i.e., there is no sharp peak in the diffraction pattern) but has a broad diffraction pattern, that is, the powder of Example 1 is amorphous. In contrast to this, the results shown in FIG. 4 reveal that the powder manufactured by the conventional process has a sharp peak in the diffraction pattern and is not solidified therefore to amorphous shape to a satisfactory degree.

The degree of amorphousness of both amorphous alloy powders was examined by differential thermal analysis. The results are shown in Table 2 below.

TABLE 2

| | | Degree of Amorphousness |
|---|---|---|
| This invention | No. 1 | 100% |
| Conventional Example | No. 2 | 63% |

It is seen from Table 2 that the alloy powder can be completely amorphous by the process of the present invention.

Figure 5A:
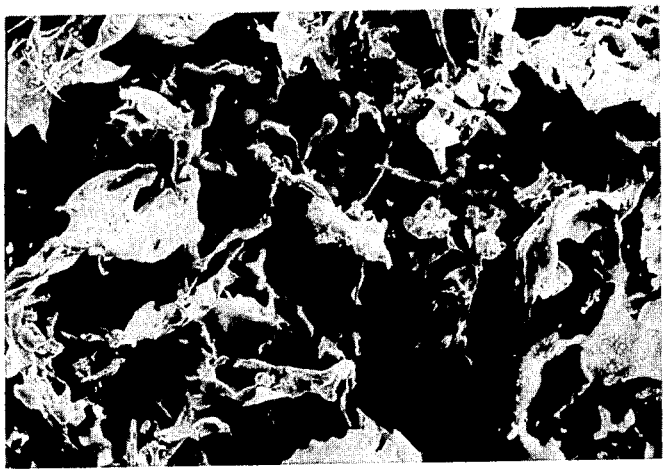
FIG. 5(*a*) is a microphotograph showing as example of the particle shape of an amorphous alloy powder manufactured by the process of the present invention, and FIG. 5(*b*) is a microphotograph showing an example of the shape of particles of an amorphous alloy powder manufactured by the conventional process.
Figure 5B:
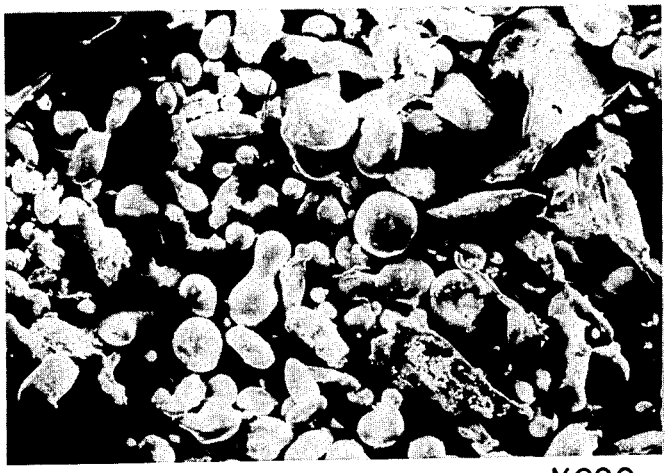

The shape of particles of both amorphous alloy powders (Nos. 1 and 2) was examined with a microscope. Microphotographs of typical particles of the respective amorphous alloy powders are shown in FIG. 5(*a*) (powder of Example; No. 1) and FIG. 5(*b*) (powder of Conventional method; No. 2).

The powders Nos. 1 and 2 were examined for their apparent density (A.D.) and flow rate (F.R.). The results are shown in Table 3 below.

TABLE 3

| | A.D. | F.R. |
|---|---|---|
| This invention | 0.98 | No flowability |
| Conventional method | 2.34 | 27.8 |

It can be seen from Table 3 above that the powder of Example 1 has much lower apparent density and worse flowability than those of the powder of Conventional method, revealing that the particles shape of Example 1 is much more irregular.

EXAMPLE 2

Amorphous alloy powders (Example 2 and Conventional method; Nos. 1 and 2) were prepared in following. Five kilograms of an alloy in composition of 75 atomic % Fe, 10 atomic % Si and 15 atomic % B were prepared by melting and then atomized in the same operating conditions as in Example 1. The degree of amorphousness of the resultant powders measured by differential thermal analysis is shown in Table 4 below.

TABLE 4

| | | Degree of Amorphousness |
|---|---|---|
| This invention | No. 1 | 100% |
| Conventional method | No. 2 | 56% |

EXAMPLE 3

Amorphous alloy powders (Example 3 and Conventional method; Nos. 1 and 2) were prepared following. Five kilograms of an alloy in composition of 75 atomic % Fe, 15 atomic % Si and 10 atomic % B were prepared by melting and then atomized in the same operating conditions as in Example 1. The degree of amorphousness of the resultant powders measured by differential thermal analysis is shown in Table 5 below.

TABLE 5

| | | Degree of Amorphousness |
|---|---|---|
| This invention | No. 1 | 100% |
| Conventional method | No. 2 | 46% |

EXAMPLE 4

Amorphous alloy powders of Example 4 and Conventional method were manufactured under the following conditions.

Four kilograms of an alloy consisting of 80 atomic % Fe and 20 atomic % B were used. The melt temperature was 1,400° C. The pressure of a high-pressure fluid jet (water) sprayed from the spraying nozzle was 100 kg/$cm^2$ and the flow rate of the water was 250 l/min.

The merging angle of the high-speed fluid jet was 40°. The action tube had an inner diameter of 40 mm and a length of 500 mm. The pressure difference between the upper and the lower chambers was 70 $mmH_2O$. The degree of amorphousness (as tested by differential thermal analysis) of the obtained amorphous alloy powders is shown in Table 6.

TABLE 6

| | Degree of Amorphousness |
|---|---|
| This invention | 100% |
| Conventional method | 67% |

EXAMPLE 5

Amorphous alloy powders of Example 5 and the Conventional method were manufactured under the following conditions.

Five kilograms of an alloy consisting of 40 atomic % Fe, 40 atomic % Ni, and 20 atomic % B were used. The melt temperature was 1,400° C. The spraying pressure of a high-pressure fluid jet (water) sprayed from the spraying nozzle was 110 $kg/cm^2$ and the flow rate of the water was 260 l/min. The merging angle of the high-speed fluid jet was 50°. The action tube had inner diameter of 50 mm and length of 500 mm. The pressure difference between the upper and the lower chambers was 85 $mmH_2O$. The degree of amorphousness (as tested by differential thermal analysis) of the obtained amorphous alloy powders is shown in Table 7.

TABLE 7

| | Degree of Amorphousness |
|---|---|
| This invention | 100% |
| Conventional method | 52% |

EXAMPLE 6

Amorphous alloy powders of Example 6 and Conventional method were manufactured under the following conditions.

Five kilograms of an alloy consisting of 68 atomic % Fe, 10 atomic % Cr, 2 atomic % Mo, 13 atomic % P, and 7 atomic % C were used. The melt temperature was 1,400° C. The spraying pressure of a high-pressure fluid jet (water) sprayed from the spraying nozzle was 120 $kg/cm^2$ and the flow rate of the water was 270 l/min. The merging angle of the high-speed fluid jet was 68°. The action tube had inner diameter of 50 mm and length of 450 mm. The pressure difference between the upper and lower chambers was 100 $mmH_2O$. The degree of amorphousness (as tested by differential thermal analysis) of the obtained amorphous alloy powders is shown in Table 8.

TABLE 8

| | Degree of Amorphousness |
|---|---|
| This invention | 100% |
| Conventional method | 58% |

Example 7 (The apparatus shown in FIG. 2 was used in Examples 7 to 12.)

5 Kg of an alloy consisting of 80 atomic % Fe, 13 atomic % P, and 7 atomic % C was melted. The resultant melt was made to flow from the nozzle opening at 1,400° C. (melt temperature). A high-pressure fluid jet (water) was sprayed at a pressure of 105 $kg/cm^2$, a flow rate of 280 l/min, and fluid merging angle of 40°. The powder particles were then collided against the cooling block to obtain amorphous alloy powders (No. 3) of Example 7. The block had a conical upper portion and a vertex angle $\theta$ of 120° and a diameter of 150 mm. The wall member surrounding the cooling block had inner diameter of 200 mm and length of 200 mm.

The size distribution of the resultant amorphous alloy powders were examined, and the result is shown in Table 9. For the purpose of comparison, amorphous alloy powders (No. 4) of the Conventional method was prepared under the same conditions using the same apparatus but with the cooling block and the wall member removed. The size distribution of the obtained powders was examined, and the results are shown in Table 9 below.

TABLE 9

| | | Size distribution | | | | | | | | |
|---|---|---|---|---|---|---|---|---|---|---|
| Mesh | | +100 | +120 | +145 | +170 | +200 | +250 | +280 | +350 | −350 |
| Particle size (μm) | | 149 | 125 | 105 | 88 | 74 | 63 | 53 | 44 | 44 |
| This invention | No. 3 | 14.32 | 5.68 | 6.13 | 6.54 | 6.14 | 6.18 | 5.87 | 5.93 | 43.21 |
| Conventional method | No. 4 | 2.68 | 2.97 | 5.13 | 5.68 | 6.73 | 6.95 | 6.08 | 6.18 | 57.60 |

Different parts of powders (No. 3) having +100 mesh, −100 to +350 mesh and −350 mesh were subjected to X-ray diffractiometry so as to examine if they were made completely amorphous. The results are shown in FIG. 6(*a*) (+100 mesh), FIG. 6(*b*) (−100 to +350 mesh) and FIG. 6(*c*) (−350 mesh).

Figure 6:
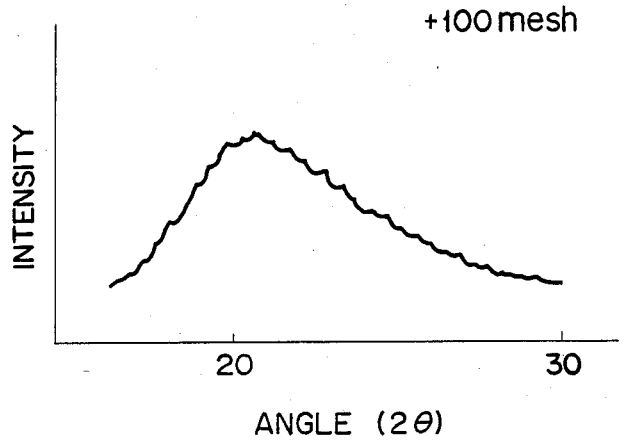
FIGS. 6(*a*) to 6(*c*) are graphs showing the results obtained in an X-ray diffractiometry performed so as to demonstrate that amorphous alloy powders of +100 mesh, −100 to +350 mesh, and −350 mesh obtained by the process of the present invention (with the apparatus shown in FIG. 2) are rendered completely amorphous.
Figure 6:
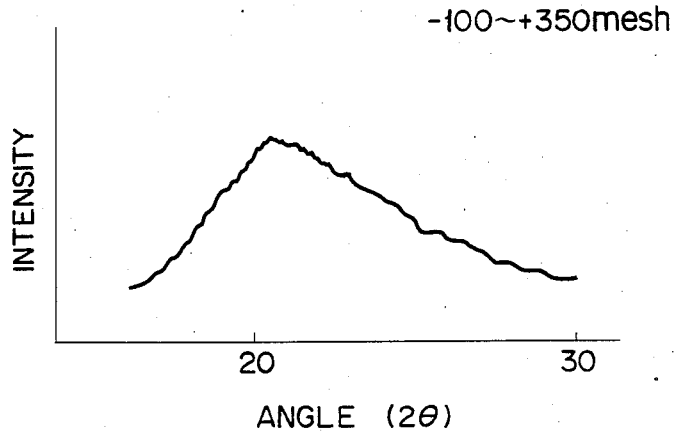
Figure 6:
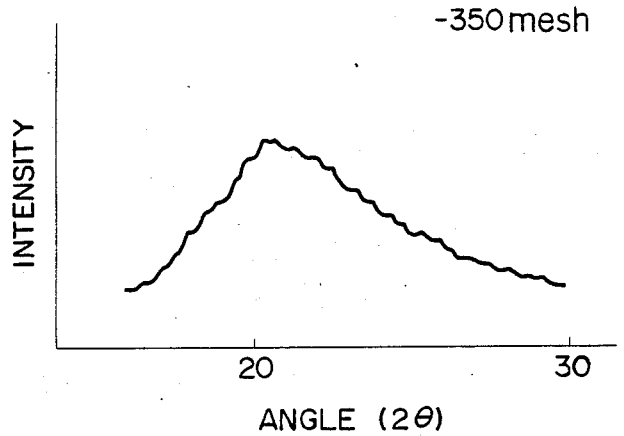

It can be seen from FIGS. 6(*a*) to 6(*c*) that the powder of Example 7 does not have a crystalline diffraction pattern (sharp peak) but has a broad diffraction pattern, therefore, showing that the powder of Example 7 is amorphous.

The degree of amorphousness of each amorphous alloy powder was examined by differential thermal analysis. The results are shown in Table 10 below.

TABLE 10

| | | Degree of Amorphousness |
|---|---|---|
| This invention | No. 3 | 100% |
| Conventional method | No. 4 | 47% |

It can be seen from Table 10 above that the alloy powder obtained in Example 7 is made completely amorphous.

The powder of Example 7 (No. 3) and that of Conventional method (No. 4) were measured for their apparent density (A.D.) and flow rate (F.R.). The results are shown in Table 11 below.

TABLE 11

| | A.D. | F.R. |
|---|---|---|
| This invention | 1.05 | No flowability |
| Conventional method | 2.46 | 24.9 |

It can be seen from Table 11 above that the amorphous alloy powder of Example 7 has a much lower apparent density and flowability than those of the Conventional method. This fact reveals that the powder particles of Example 7 have a more irregular shape than those of the Conventional method.

EXAMPLE 8

Amorphous alloy powders (Example 8 and the Comparative Example) were prepared following. Five kilograms of an alloy in composition of 75 atomic % Fe, 10 atomic % Si and 15 atomic % B were prepared by melting and then atomized in the same operating conditions as in Example 7. The degree of amorphousness of the resultant powders measured by differential thermal analysis is shown in Table 12 below.

TABLE 12

| | Degree of Amorphousness |
|---|---|
| This invention | 100% |
| Conventional method | 48% |

EXAMPLE 9

Amorphous alloy powders (Example 9 and Conventional method) were prepared following. Five kilograms of an alloy in composition of 75 atomic % Fe, 15 atomic % Si and 10 atomic % B were prepared by melting and then atomized in the same operating conditions as in Example 7. The degree of amorphousness of the resultant powders measured by differential thermal analysis is shown in Table 13 below.

TABLE 13

| | Degree of Amorphousness |
|---|---|
| This invention | 100% |
| Conventional method | 38% |

EXAMPLE 10

Amorphous alloy powders of Example 10 and Conventional method were manufactured under the following conditions.

Five kilograms of an alloy consisting of 80 atomic % of Fe and 20 atomic % of B were melted. The melt temperature was 1,400° C. The spraying pressure of a high-pressure fluid jet (water) sprayed from the spraying nozzle was 90 kg/cm$^2$ and the flow rate of the water was 260 l/min. The merging angle of the high-speed fluid jet was 30°. The cooling block had diameter of 130 mm and a vertex angle of 100°. The wall member had inner diameter of 160 mm. The degree of amorphousness (as tested by differential thermal analysis) of the obtained amorphous alloy powders is shown in Table 14.

TABLE 14

| | Degree of Amorphousness |
|---|---|
| This invention | 100% |
| Conventional method | 53% |

EXAMPLE 11

Amorphous alloy powders of Example 11 and Conventional method were manufactured under the following conditions.

Three kilograms of an alloy consisting of 40 atomic % Fe, 40 atomic % Ni and 20 atomic % B were melted. The melt temperature was 1,400° C. The spraying pressure of a high-pressure fluid jet (water) sprayed from the spraying nozzle was 107 kg/cm$^2$ and the flow rate of the water was 290 l/min. The merging angle of the high-speed fluid jet was 40°. The cooling block had diameter of 150 mm and a vertex angle of 90°. The wall member had inner diameter of 170 mm. The degree of amorphousness (as tested by differential thermal analysis) of the obtained amorphous alloy powders is shown in Table 15.

TABLE 15

| | Degree of Amorphousness |
|---|---|
| This invention | 100% |
| Conventional method | 52% |

EXAMPLE 12

Amorphous alloy powders of Example 12 and the Conventional method were manufactured under the following conditions.

Three kilograms of an alloy consisting of 68 atomic % Fe, 10 atomic % Cr, 2 atomic % Mo, 13 atomic % P, and 7 atomic % C were melted. The melt temperature was 1,400° C. The spraying pressure of a high-pressure fluid jet (water) sprayed from the spraying nozzle was 110 kg/cm$^2$ and the flow rate of the water was 250 l/min. The merging angle of the high-speed fluid jet was 55°. The cooling block had diameter of 180 mm and a vertex angle of 110°. The wall member had inner diameter of 200 mm. The degree of amorphousness (as tested by differential thermal analysis) of the obtained amorphous alloy powders is shown in Table 16.

TABLE 16

| | Degree of Amorphousness |
|---|---|
| This invention | 100% |
| Conventional method | 55% |

What is claimed is:

1. A process for manufacturing amorphous alloy powders, comprising the steps of:

causing the melt of an alloy, which can be made amorphous, to flow down from a nozzle provided at the bottom of a crucible filled with the melt;

blowing a high-speed liquid from a spraying nozzle against the melt flowing downwards from the nozzle, thereby powderizing the melt;

introducing the powderized alloy and a high-speed liquid into an action tube extending along the stream of the melt of the alloy and surrounding the atomizing zone positioned under a spraying nozzle, said action tube having an upper and lower chamber formed above and below the action tube; and the pressure in said upper chamber is lower as much as 20 mm $H_2O$ to 200 mm $H_2O$ than that in said lower chamber; and colliding the powderized alloy against the high-speed liquid due to the pressure reduction and turbulent flow in the action tube, thereby achieving a rapid heat exchange between the powderized alloy and the high-speed liquid, and causing rapid cooling and solidifying of the powderized alloy to form amorphous powders.

2. A process according to claim 1, wherein the alloy which can be made amorphous is of an alloy selected from the group consisting of a eutectic alloy and a quasi-eutectic alloy which have a composition consisting of 65 to 85 atomic percent of the transition metal and 15 to 35 atomic percent of a metalloid.

3. A process according to claim 2, wherein the transition metal is at least one metal element selected from the group consisting of iron, nickel, chromium, cobalt and vanadium, and the metalloid is at least one metalloid element selected from the group consisting of boron, carbon, silicon, phosphorus, and germanium.

4. A process according to claim 1, wherein the alloy which can be made amorphous comprises an alloy selected from the group consisting of an intermetallic compound alloy and a quasi-intermetallic compound alloy which comprise a combination of one or more metals.

5. A process according to claim 1, wherein the alloy which can be made amorphous comprises an alloy selected from the group consisting of an intermetallic compound alloy and a quasi-intermetallic compound alloy which comprise a combination of one or more metals with one or more rare earth metal elements.

6. A process according to claim 1, wherein said spraying nozzle emits a high-speed liquid jet in the form of an inverted cone, the merging angle of this jet being 30° to 100°.

7. A process according to claim 1, wherein the high-speed liquid jet is water.

8. A process according to claim 7, wherein water as the high-speed liquid jet is sprayed at pressure of not lower than 80 kgf/cm$^2$.

9. A process according to claim 1, wherein the action tube has inner diameter which is 0.2 to 3.0 times as much as inner diameter of the opening of the said spraying nozzle, and the said action tube has a length of not less than 10 cm.

10. A process according to claim 1, wherein the pressure in the said upper chamber is lower as much as 40 to 200 mm$H_2O$ than that inside said lower chamber.

11. A process according to claim 1, wherein an overflowing exhaust pipe is connected to a lower side of a tank which has the said spraying nozzle and the said action tube therein, and a powder buffer plate is arranged at a position just under the said action tube at a distance therefrom and above the said exhaust pipe.

12. A process for manufacturing amorphous alloy powders comprising the steps of:

causing the melt of an alloy, which can be made amorphous, to flow down from a nozzle provided at the bottom of a crucible filled with the melt and the step of blowing a high-speed liquid from a spraying nozzle against the melt flowing dowards from the nozzle, thereby powderizing the melt;

colliding the powderized alloy against a block arranged immediately below a convergence point of the high speed liquid from the spraying nozzle and by a given distance, said block having cooling means for cooling the melt and having a conical top part opposing the lower end of said spraying nozzle;

achieving a rapid heat exchange between the powderized alloy and the high-speed liquid due to the collision; and rapidly cooling and solidifying the powderized alloy, thus forming amorphous powders.

13. A process according to claim 12, wherein the alloy which can be made amorphous is of an alloy selected from the group consisting of a eutectic alloy and a quasi-eutectic alloy which have a composition consisting of 65 to 85 atomic percent of the transition metal and 15 to 35 atomic percent of a metalloid.

14. A process according to claim 12, wherein the transition metal is at least one metal element selected from the group consisting of iron, nickel, chromium, cobalt and vanadium, and the metalloid is at least one metalloid element selected from the group consisting of boron, carbon, silicon, phosphorus, and germanium.

15. A process according to claim 12, wherein the alloy which can be made amorphous comprises an alloy selected from the group consisting of an intermetallic compound alloy and a quasi-intermetallic compound alloy which comprise a combination of one or more metals.

16. A process according to claim 12, wherein the alloy which can be made amorphous comprises an alloy selected from the group consisting of an intermetallic compound alloy and a quasi-intermetallic compound alloy which comprise a combination of one or more metals with one or more rare earth metal elements.

17. A process according to claim 12, wherein said spraying nozzle emits a high-speed liquid jet in the form of an inverted cone, the merging angle of this jet being 30° to 100°.

18. A process according to claim 12, wherein the high-speed liquid jet is water.

19. A process according to claim 18, wherein water as the high-speed fluid jet is sprayed at pressure of not lower than 80 kgf/cm$^2$.

20. A process according to claim 12, wherein the conical top part of said block has a tapered angle of 30° to 150°.

21. A process according to claim 12, wherein a hollow scattering prevention wall member is arranged at a distance from and around said block for cooling the melt, said scattering prevention wall member preventing the particles of the melt of the alloy from scattering upon collision against said block.

22. A process according to claim 21, wherein said wall member has inner diameter which is larger than outer diameter of said block by 10 to 100 mm.

* * * * *